US005794814A

United States Patent [19]

Baerenwald

[11] Patent Number: 5,794,814

[45] Date of Patent: Aug. 18, 1998

[54] RESILIENT INTERFACE RING FOR METAL CONTAINER

[75] Inventor: Philip M. Baerenwald, Rockton, Ill.

[73] Assignee: J. L. Clark, Inc., Rockford, Ill.

[21] Appl. No.: 862,732

[22] Filed: May 23, 1997

Related U.S. Application Data

[62] Division of Ser. No. 617,476, Mar. 15, 1996, Pat. No. 5,676,272.

[51] Int. Cl.[6] ..... B65D 43/06

[52] U.S. Cl. ..... 220/685; 220/4.24; 220/DIG. 3; 220/366.1; 220/4.21

[58] Field of Search ..... 220/4.21, 4.22, 220/4.23, 4.24, 685, 683, 682, 681, DIG. 3, 677, 4.33, 616, 366.1

[56] References Cited

U.S. PATENT DOCUMENTS

| | | | |
|---|---|---|---|
| 3,088,623 | 5/1963 | Parker | 220/4.21 |
| 3,181,726 | 5/1965 | Parker | 220/4.21 |
| 3,216,148 | 11/1965 | Amberg | 220/366.1 |
| 3,620,407 | 11/1971 | Wise | 220/4.24 |
| 3,885,701 | 5/1975 | Becklin | 220/681 |
| 4,205,762 | 6/1980 | Wolfseder | 220/4.22 |
| 4,440,307 | 4/1984 | Bartels et al. | 220/683 |
| 4,546,874 | 10/1985 | Kirchan | 220/683 |
| 4,646,933 | 3/1987 | Jurczenia et al. | 220/366.1 |
| 4,712,685 | 12/1987 | Kirchhan | 220/4.21 |

*Primary Examiner*—Stephen J. Castellano
*Attorney, Agent, or Firm*—Leydig, Voit & Mayer, Ltd.

[57] ABSTRACT

A metal container which includes two drawn container halves joined by an injection molded plastic ring. The container halves can be identical and of low profile, with upstanding walls terminating in formed edges of substantially the same size and shape. The ring includes a pair of opposed channels sharing a common base, and the formed edges of the respective container halves fit into the opposed channels of the ring. The channels and formed edges are adapted to provide tailored fitting and retention characteristics, so that one of the container half is gripped more securely by the ring, and the other container half is more readily removable.

23 Claims, 4 Drawing Sheets

RESILIENT INTERFACE RING FOR METAL CONTAINER

This is a divisional of application Ser. No. 08/617,476, filed on Mar. 15, 1996 now Pat. No. 5,676,272.

FIELD OF THE INVENTION

This invention relates generally to containers, and more particularly to thin-walled metal containers with removable/replaceable lids.

BACKGROUND OF THE INVENTION

Thin-walled metal containers having removable lids are popular for packaging certain items, where the packaging is intended to have a degree of permanence. They are advantageous in that they provide protection for the contents, and they provide the opportunity to permanently print attractive designs on the containers themselves. The containers thus can be used for long periods of time, or, in cases where the contents are consumed after a short time, the containers are sometimes kept for other storage purposes.

Metal containers also provide the opportunity for forming containers of unusual or complex shape, further increasing the attractiveness of the packaging, and the consumer appeal.

Metal containers are typically drawn and formed (as by rolling the edges to avoid exposing raw metal edges), and the die sets and machine setups for making a particular container can involve a significant expense. That expense can be justified when production runs are relatively long. It is not straightforward or inexpensive to change die sets or machine setups, to change from one size container to another. Thus, when a packaging application has a requirement for the possibility of size changes over the life of the product, it is often more convenient or cost effective to use other, more conventional types of packaging.

Metal containers have the further aspect that the tops and the bottoms are not identical, because they are intended to interfit. Typically the bottom has an edge which is inwardly rolled or hemmed to avoid exposing raw metal edges, and sometimes has a ledge formed at the upper part to serve as a receiving area/stop for the lid. The lid or cover typically has a rolled or hemmed edge to also avoid exposing raw metal edges, and that edge is typically rolled outwardly, to leave the inside wall of the lid available to fit the container bottom.

Conventionally, the bottoms are much taller than the tops, with the tops being typically in the range between about one-half to one inch tall, and the bottoms ranging from one inch to much greater depths, depending on the nature of the container and the nature of the contents. When it is desired to form a shallower container, it is necessary to alter the drawing and forming apparatus for at least the bottoms, and as pointed out above, that can be expensive. While a shallow container can conceptually be made by utilizing two lids, since the lids are of identical shape, they cannot interfit and thus will not form a container. Thus, in order to provide a container with a shorter profile, it will be necessary to use a different machine set-up and probably different tooling for at least one of the parts each time the depth of the container is changed. That can present an issue of expense which is not readily surmountable when using metal containers, and can drive the application to other forms of more conventional packaging.

SUMMARY OF THE INVENTION

In view of the foregoing, it is a general object of the present invention to effectively combine two identical container components, such as two container lids, to form a container of a suitable size.

More specifically, it is an object of the present invention to utilize container parts produced by existing tools to form containers of a suitable profile so as to avoid expensive retooling.

An object of the invention is to provide a cost effective mechanism for combining two container components to form a closed container that can be configured to provide controlled opening characteristics for the container.

It is another related object of the present invention to provide such a means for combining two container components to form a closed container that is simple in structure, reliable in operation, and inexpensive to produce so that forming containers by combining existing container components with such a means is a viable alternative to the expensive retooling.

According to a particular aspect of the invention, an object is to exploit the characteristics of the interface mechanism used to join two container halves, by using the interface mechanism to add internal or external features to the container.

According to these and other objects of the present invention, there is provided a metal container made of two container halves joined by a resilient ring. Each container half is a drawn shell having a closed end and upstanding walls terminating in a formed edge. The formed edges of the respective container halves are substantially identical and define a peripheral container shape. The resilient ring matches the peripheral container shape, and has upper and lower seats which share a common base. The upper and lower seats engage facing portions of the formed edges of the respective container halves, and each seat has at least one upstanding wall extending around the ring and comprising means for gripping the formed edge of a container half when seated therein. The respective seats have non-identical gripping characteristics for the associated container half such that the retention force for removal of a seated container half is different between the two seats. As such, one half always releases before the other. In the preferred form, both seats comprise channels having two upstanding walls sharing a common base, so that the upstanding walls grip the respective formed edges. In certain applications, one of the seats requires only a single upstanding wall which is frictionally engaged with the associated container half.

In a particular and currently preferred implementation, the invention provides a low profile container comprising two container halves joined by a resilient ring to form a closed container. Each of the drawn metal container halves has a closed end, upstanding walls and a formed edge, preferably curled. The ring has upper and lower channels sized to match the formed edges of the container halves and adapted to slidingly receive the formed edges. The channels are opposite each other and separated by a thin web so that when the container halves are disposed in the respective channels the height of the closed container is determined substantially by the summed height of the respective walls. The respective channels have non-identical gripping characteristics for the associated container halves such that the ring reliably attaches to one of the container halves more securely than to the other. The ring can thus define one of the identical container halves as the top and the other as the bottom.

It is a feature of the present invention to use a ring of resilient material as an interface to combine two container halves, which normally do not interfit due to the identical shape and size of their formed edges, to form a container of a suitable low profile. Thus, two container lids can be joined by such a ring to form a low profile container. In this way, the need to go through expensive retooling to produce a short container bottom is avoided. The ring is preferably formed of injection molded plastic, which is relatively inexpensive to produce.

Thus, it is an advantage according to one feature of the invention, to achieve high production quantities useful for justification of metal containers by forming each container of two parts, but where the parts are identical, and utilizing an interface ring to join the identical parts to form a two-part container.

Other objects and advantages will become apparent with reference to the following detailed description when taken in conjunction with the drawings in which:

Figure 1:
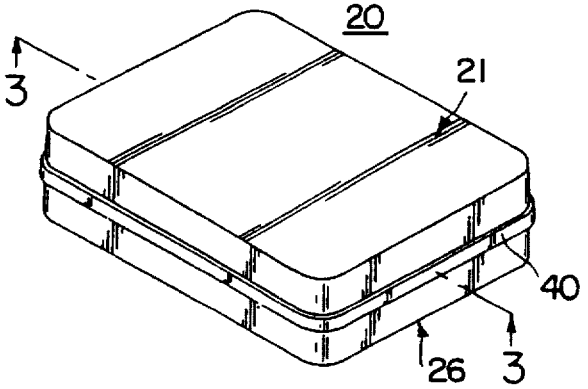
FIG. 1 is a perspective view of a low profile container with two container halves joined by a ring of resilient material.

While the invention is susceptible of various modifications and alternative constructions, certain illustrated embodiments hereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention as defined by the appended claims.

DETAILED DESCRIPTION OF THE PREFERRED EMBODIMENT

Figure 2:
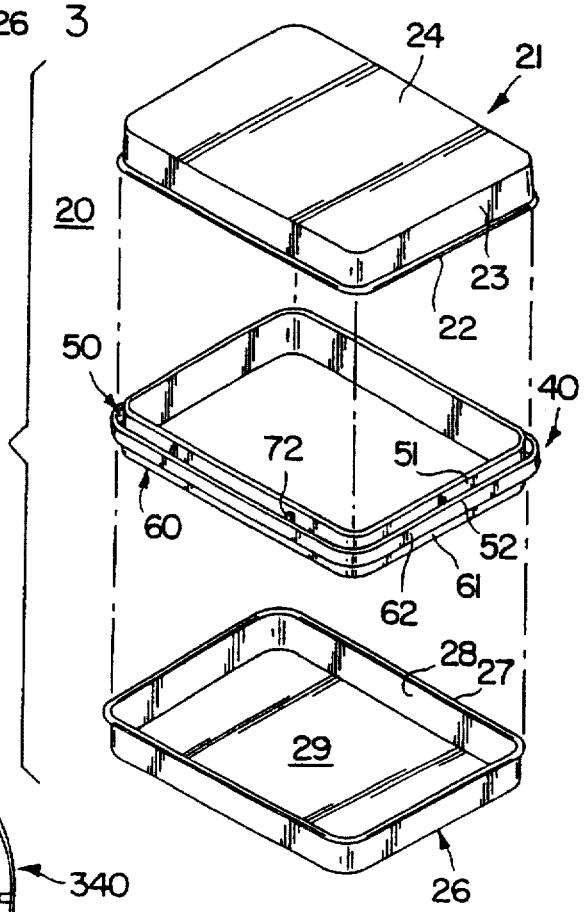
FIG. 2 is an exploded perspective view of the container of FIG. 1.
Figure 3:
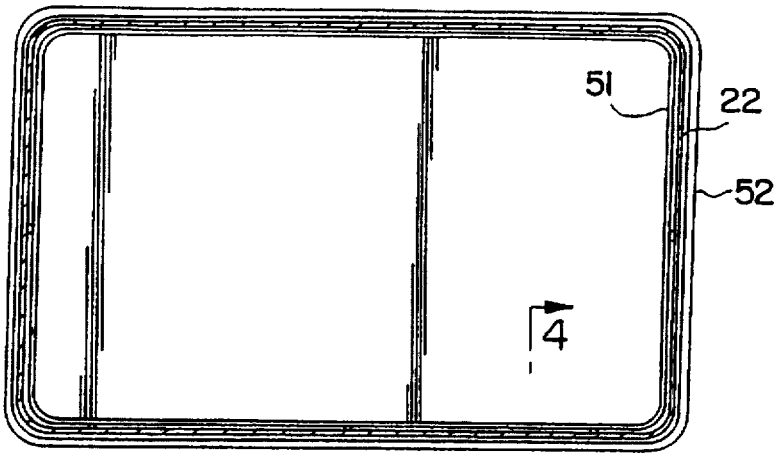
FIG. 3 is a sectional view taken along the line 3—3 of FIG. 1.

Turning now to the drawings, FIG. 1 shows a low profile metal container 20 constructed according to the teachings of the present invention, and FIG. 2 shows the container 20 in an exploded perspective view. The container 20 comprises two container halves 21 and 26 joined by a resilient ring 40 to form a closed container. As best seen in FIG. 2, each of the container halves 21 and 26 comprises a thin metal body which is typically formed by drawing. The metal body of the container half 26 has a closed end 29, upstanding walls 28, and a formed edge 27. Likewise, the body of the container half 21 has a closed end 24, upstanding walls 23, and a formed edge 22. The edges 22 and 27 are formed to eliminate any exposed raw edges of the sheet metal making up the container halves. The formed edges also tend to rigidify the container by providing a channel-like structure at the open end. When used herein, the term "formed edge", unless otherwise indicated by the context, is intended to encompass the various metal forming techniques which can be used to shape the container edge. In the FIG. 1 embodiment, the formed edge is typically referred to as a curled or rolled edge. As will be described in greater detail below, the invention also has applicability to a teardrop-shaped or a hemmed edge, both being broadly encompassed within the term formed edge. In addition, the preferred embodiment of the invention shows the formed edge as being an outwardly curled edge. It will also become more apparent, that the formed edge, be it curled or teardropped or seamed can also in most cases be inwardly formed. Returning to the showing of FIG. 1, the formed edges 22 and 27 of the container halves are substantially identical, and define a peripheral container shape. Because the two formed edges have the same size and shape, the container halves 21 and 26 do not interfit and therefore cannot be directly mated to form a closed container.

Figure 4:
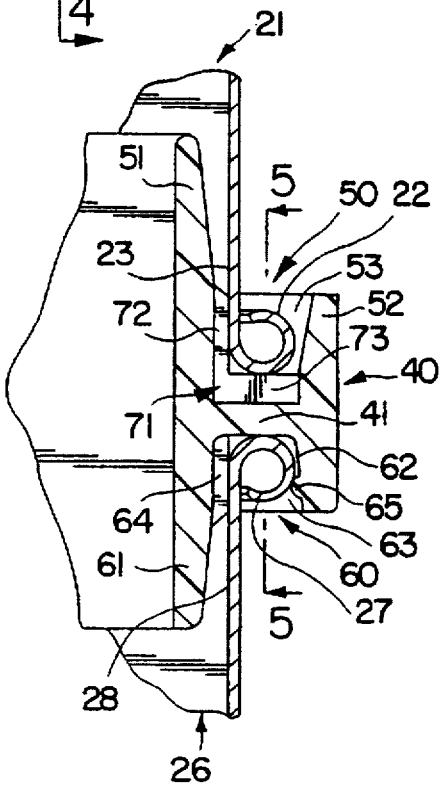
FIG. 4. is an enlarged sectional view showing the formed edges of the container halves received in the respective channels in the ring and taken along the line 4—4 of FIG. 3.

In accordance with a feature of the present invention, a resilient ring 40 is provided as an inexpensive interface between the container halves 21 and 26 so that they can be joined to form a unitary container. The ring 40 is shaped to match the peripheral shape of the container halves 21 and 26 for joining the container halves at their respective formed edges 22 and 27. To that end, the ring 40 has an upper seat 50 and a lower seat 60 for engaging facing portions of the edges 22 and 27 of the respective container halves. The upper and lower seats 50 and 60 are disposed opposite each other and share a common base 41 (FIG. 4). Each of the seats 50 and 60 has at least one upstanding wall extending around the ring and comprises means for gripping the formed edge of a container half when the edge is inserted in the seat. By using different types of gripping means, the fit between the seats 50 and 60 and the formed edges 22 and 27 of the container halves may be rigidly attached, snugly fit, loosely fit, or any combination thereof, depending on the end-use requirements for the container.

In the illustrated embodiment, the container halves 21 and 26 are two identical container lids, which are typically significantly shorter in height than the regular container bottoms designed to match them. Joining the two lids 21 and 26 together with the ring 40 thus forms a container with a low profile. It will be appreciated, however, that a container can also be formed by joining container halves of different heights with a ring as long as they have substantially identical formed edges.

Because the formed edges 22 and 27 of the container halves 21 and 26 are substantially identical, they can be inserted into either of the upper and lower seats 50 and 60, and either of halves can be designated as the top or bottom of the container. However, it is often preferred to configure the container so that the ring 40 remains attached to a pre-selected one of the container halves when a user opens the container. The container half that is removed to open the container may be designated as, for example, the container top, and the other would then be the container bottom. In accordance with the teaching of the present invention, the upper and lower seats are configured to have different gripping characteristics so that the retention force for removal of a container half from one of the seats is greater than the retention force for the other seat. In this way, the gripping characteristics of the seats define which container half is the container top, and which one is the bottom. More specifically, if the lower seat attaches the ring more securely to a container half than does the upper seat, then the container half attached to the lower seat may be designated as the container bottom, and the other half the container top. Such designation, of course, may be reversed, depending on the end purpose of the container. Moreover, in certain applications it may be preferred that no such distinction between the container halves be made. In such a case, the two seats can be identically configured to provide the same gripping characteristics.

In the present embodiment, each of the upper and lower seats 50 and 60 of the ring 40 is in the form of a channel. As can be best seen in the sectional view of the container in FIG. 4, the upper channel 53 is defined by the upstanding walls 51 and 52 and the base 41. Similarly, the lower channel is defined by the upstanding walls 61 and 62 and the base 41. The upper and lower channels 53 and 63 are opposite to each other and separated by the base 41 which, in this embodiment, is in the form of a web joining the upstanding walls. Due to the relative thinness of the base 41, when the two container halves are disposed in the respective channels 53 and 63, the height of the closed container is determined substantially by the summed height of the respective walls 23 and 28 of the container halves.

The upper and lower channels 53 and 63 are sized to be sufficiently wide to match the formed edges 22 and 27 of the container halves 21 and 26 to slidingly receive the formed edges. As shown in FIG. 4, the channels 53 and 63 are of substantially the same size, so that the identical edges of the container halves can fit within the channels.

In order to hold the container halves 21 and 26 together to form a closed container, each of the upper and lower channels 53 and 63 is provided with means for gripping the formed edge of a container half when inserted therein. As thus used, "gripping" is broadly intended, to extend from a relatively secure snap fit as will be discussed below to a very loose sliding fit for covers which are intended for easy removal. As described above, it is preferred that the gripping means in the lower and upper channels are configured differently so that the channels have non-identical gripping characteristics. In the present embodiment, the lower channel 63 is configured to provide a higher retention force than that of the upper channel 53, and the container half 26 attached to the lower channel is defined as the container bottom, and the container half 21 the container top. Thus, when a user pulls on the two container halves 21 and 26 to open the container, the upper channel will release before the lower channel.

The ring 40 is injection molded of resilient plastic material, preferably a polyolefin. Such a molded plastic ring can be configured easily to provide the desired gripping characteristics, and is relatively inexpensive to manufacture.

In the present embodiment, the gripping means used in the lower channel 63 includes a plurality of detent protrusions and "crush" ribs. The detent protrusions are used to relatively rigidly attach the ring 40 to the container half 26. As illustrated in FIG. 4, preferably the detent protrusions is in the form of nibs 65 protruding from spaced locations on the upstanding wall 62 into the lower channel 63. The nibs are located at a predetermined height from the base 41 such that they snap on and capture the edge 27 of the container half 26 when inserted therein to securely hold the formed edge in the lower channel 63. With this arrangement, the parts fit together with a noticeable click or snap as the nib, which is deflected over the formed edge, snaps back into position as the formed edge bottoms in the channel. Instead of using a series of nibs 65 disposed at selected positions, it is also possible to use a continuous nib on the wall 62 extending around the ring 40 to capture the formed edge.

If, however, a snug slip fit without detent is desired, then the nibs 65 can be eliminated to use only the crush ribs 64 for gripping the edge 27. The crush ribs 64 project from the upstanding wall 61 into the lower channel and extend generally perpendicular to the base 41. When the edge 27 of the container half 26 is inserted into the lower channel 63, the crush ribs 64 engage and are deflected by the inner surface of the upstanding wall 28 of the container half 26 adjacent the edge 27 to provide a snug fit between the channel and the container half. It will be appreciated that gripping means such as crush ribs or detent nibs can also be used in the upper channel 53, and that other types of gripping means can also be employed in either channel to provide the desired gripping characteristics.

Figure 5:
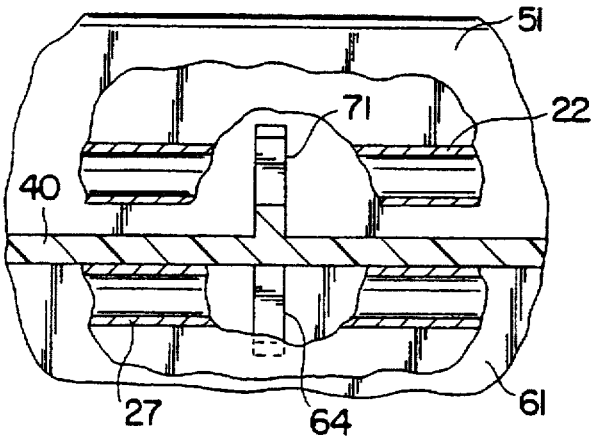
FIG. 5 is a sectional view, partly cut away illustrating gripping means disposed in the channels of the ring and taken along the line 5—5 of FIG. 4.

As an ancillary feature of the present invention, the upper channel 63 is provided with vent means for preventing vacuum buildup which would resist removal of the cover. It is well known that during the removal of a lid from a container, the expansion of the volume in the container due to the displacement of the lid can cause the pressure in the container to be lower than the pressure outside. Such a pressure difference, or vacuum buildup, can resist removal of the container lid. In the present embodiment, the vent means prevents vacuum buildup and includes a plurality of L-shaped ridges 71 transversely disposed in the upper channel 53. As illustrated in FIG. 4, each of the L-shaped ridges 71 has a vertical portion 72 protruding from the upstanding wall 51, and a horizontal portion 73 extending across the base 41, which forms the bottom of the channel 53. The L-shaped ridges 71 serve as standoffs to prevent the formation of an air tight seal between the formed edge 22 and the upper channel 53, thereby preventing vacuum buildup when the container half 21 is withdrawn from the upper channel. The vertical portions 72 of the L-shaped ridges 71 further serve the function of the crush ribs 64. As shown in FIG. 4, the vertical portions 72 of the L-shaped ridges 71 engage and are deflected by the inner surface of the upstanding wall 23 adjacent the formed edge 22 to provide a snug fit between the upper channel 53 and the container half 21. A partially cutaway cross sectional view of the ring 40 showing a crush rib 64 and a L-shaped ridge 71 is provided in FIG. 5.

Figure 18:
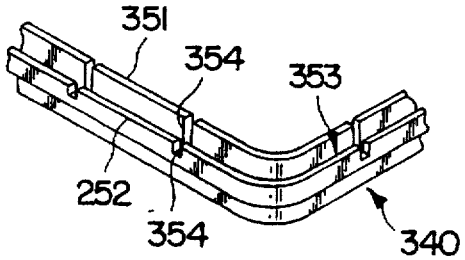
FIG. 18 is a perspective view showing a portion of yet another embodiment of the invention, illustrating an alternative form of vent means.

It will be appreciated that a variety of vent means can be used to prevent vacuum buildup without deviating from the scope and spirit of the present invention. For example, FIG. 18 shows an alternative embodiment of a ring 340 which uses slots 354 on the walls 351 and 352 of the upper channel 353 as the vent means. In the illustrated embodiment, the slots 354 divide the upstanding walls 351 and 352 into segments, and the upper channel 353 is thus interrupted instead of being continuous along the ring. Those slots 354 allow air to flow into the interior of a container formed with the ring 340, thereby preventing vacuum buildup in the container when a user opens it. This embodiment also illustrates that portions of the ring, such as one or more of the upstanding walls forming the channels can be segmented, as desired in order to suit the requirements of a particular container application.

Figure 6:
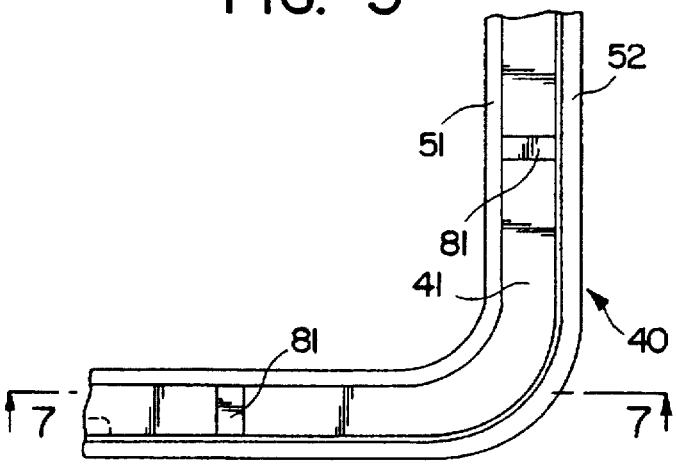
FIG. 6 is a partial plan view showing a corner of the ring illustrating two standoff ridges in the upper channel of the ring.
Figure 7:
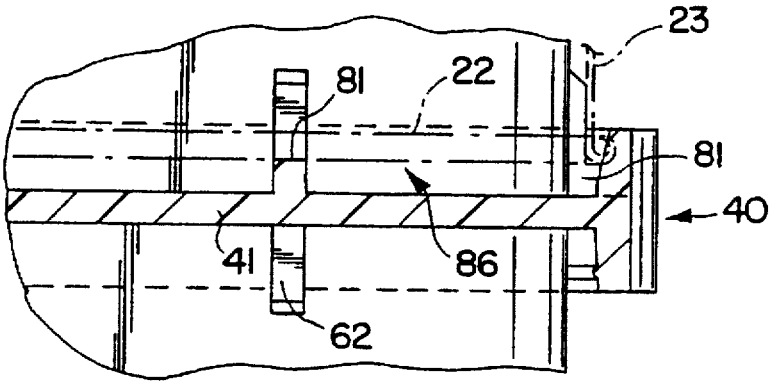
FIG. 7 is a sectional view taken along the line 7—7 of FIG. 6.
Figure 8:
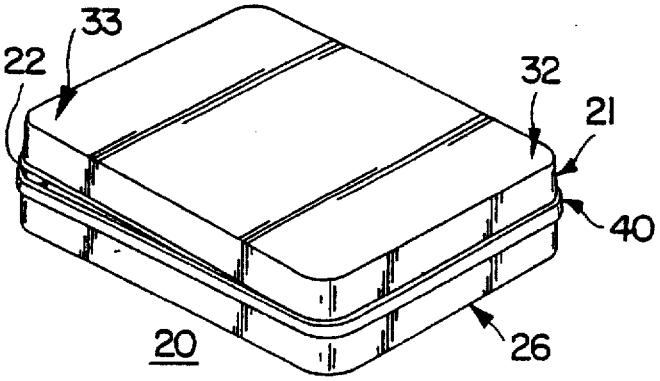
FIG. 8 is a perspective view of the container with a corner of the container top pressed down to pivot an opposite section of the top out of the ring.

Referring now to FIGS. 6–8, as another auxiliary feature of the present invention, the ring 40 is configured such that the container 20 can be opened by compressing a pinch-to-open section 32 of the container. Conveniently, the pinch-to-open feature is positioned at one or more corners of the container, although, when desired, it can be positioned along an edge or at a preferred portion of a complex shape. In practice, the pinch-to-open feature is implemented by providing two standoff ridges 81 in the upper channel 53 at locations adjacent the pinch-to-open section 32. In the present embodiment, the standoff ridges 81 are in the form of the L-shaped ridges 71 described above in conjunction with FIG. 4. When used for venting, the standoff height of the ribs from the base can be relatively small. However, when used in the pinch-to-open feature, the standoff ridges 81 need be tall enough to allow a portion of the upper container to deflect into the channel portion encompassed by the ridges by a sufficient amount to allow the opposite end of the container lid to raise. More particularly, as can be seen in the sectional view of FIG. 7, the standoff ridges 81 form a recess between the base 41 and the formed edge 22 (shown in dashed lines) when the container is closed. When the pinch-to-open corner section 32 of the container half 21 is depressed, the formed edge 22 of container half 21 at the corner 32 is pushed towards the base 41 and received in the recess, causing the section 33 of the container half 21 opposite the pinch-to-open section 32 to be pivoted upward and out of the upper channel 53 of the ring 40. The opening feature is illustrated in FIG. 8 which shows the corner 32 as being compressed so that the corner section fits into the channel made by the ribs 81, causing the opposite corner 33 to rise. In this way, the container pops open by simple pressure on one corner.

Figure 9:
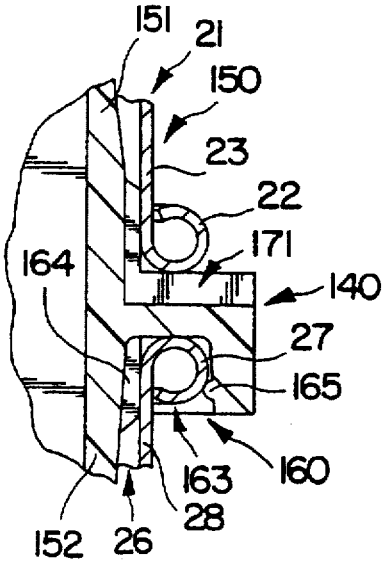
FIG. 9 is an enlarged partial cross sectional view of an alternative embodiment of the invention.

Turning then to FIG. 9, there is shown a further embodiment of the invention, in which the opposed seats for the container halves are differently configured. In this embodiment, the upper seat 150 has only one upstanding wall 151, for gripping the formed edge 22, shown as a curled edge. Like the embodiment shown in FIG. 4, the present embodiment of the ring 140 is also provided with detent nibs 165 and crush ribs 164 in the lower channel 160 for securely holding the curled edge 27 of the container half 26. The upper seat 150 includes L-shaped ridges 171, which engage the upstanding wall 23 to provide a reasonably snug and controlled fit between the ring 140 and the container half 21.

Figure 10:
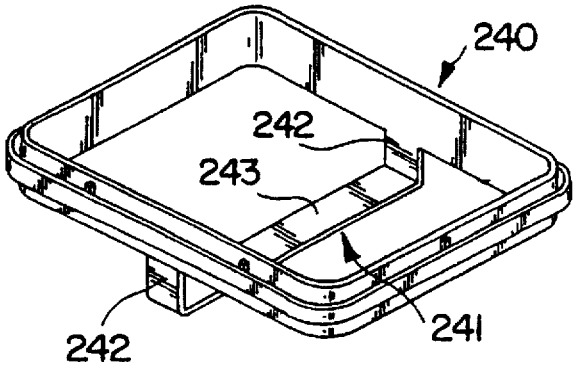
FIG. 10 is a perspective view showing another alternative embodiment including a stabilizing web connecting two opposed sections of the ring.

In accordance with one special benefit of the invention, it is possible to make even fuller use of the resilient interface ring by molding the ring to include special purpose internal or external features. Thus, in accordance with this aspect of the invention, the ring can be injection molded with special features such as the stabilizing web 241 shown integral with the ring 240 in FIG. 10. The web 243 is integral with the interior vertical wall of the ring, and in this example is entirely disposed within the container. Examples of other special features, both internal and external, will be given below. However, referring to FIG. 10, because the ring of the present invention is formed of resilient material such as plastic, the ring may become somewhat floppy when the size of the ring is sufficiently large, and therefore may not rigidly retain its shape when it is being handled, which may increase the effort required for mounting the ring on an associated container half. The stabilizing web 241, which connects two opposed sections of the ring, maintains the shape of the ring, thereby facilitating the installation of the ring. To avoid obstruction of the interior space of the container, the web 241 is designed to lay closely alongside the interior periphery of the container bottom. As shown in FIG. 10, the web 241 has a generally U-shaped body including two downwardly extending portions 242 and a horizontal portion 243. The web 241 is sized such that when the ring 240 is attached to the container half 26, the two portions 242 extend along the upstanding walls 27, and the horizontal portion 243 extends across the closed end 28.

The invention has been described above in connection with a rectangular container in order to simplify the drawings and allow the description to focus on important aspects of the invention. It will now be recognized that the invention is particularly suitable to containers of complex or unusual shape. Assuming the appropriate quantities are required, drawing and forming equipment can be configured and set up to draw a large number of identical container halves. Due to the use of identical tops and bottoms, the quantity restrictions are relieved, in that each container requires two identical drawn and formed metal parts.

Figure 11:
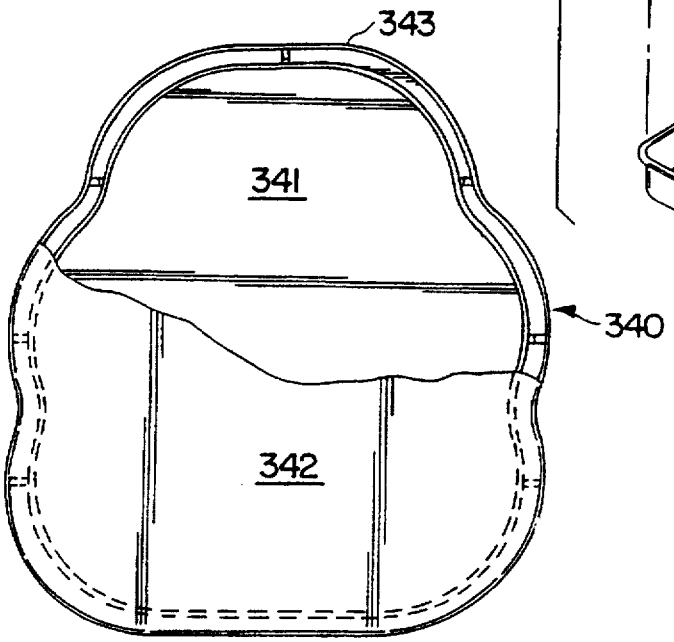
FIG. 11 is a plan view showing a container of non-rectangular complex shape.

FIG. 11 of the drawings shows a container having a shape to form an embodiment of the present invention which is currently preferred. It is preferred at least in the sense that the unusual irregular shape of the container, combined with relatively low profile (on the order or 0.75 inches per half) provides a commercially attractive package. Other than the shape, however, the embodiment of FIG. 11 is like that illustrated in and described in connection with the previous drawings. More particularly, it will be seen that container 340 of FIG. 11 includes a container bottom 341, a container top 342 joined by a resilient injection molded plastic ring 343. While it is not completely illustrated in the drawings, the ring 343 is like that illustrated in connection with the FIG. 1 embodiment, except that the peripheral shape of the ring matches the peripheral shape of the container halves.

Figure 12:
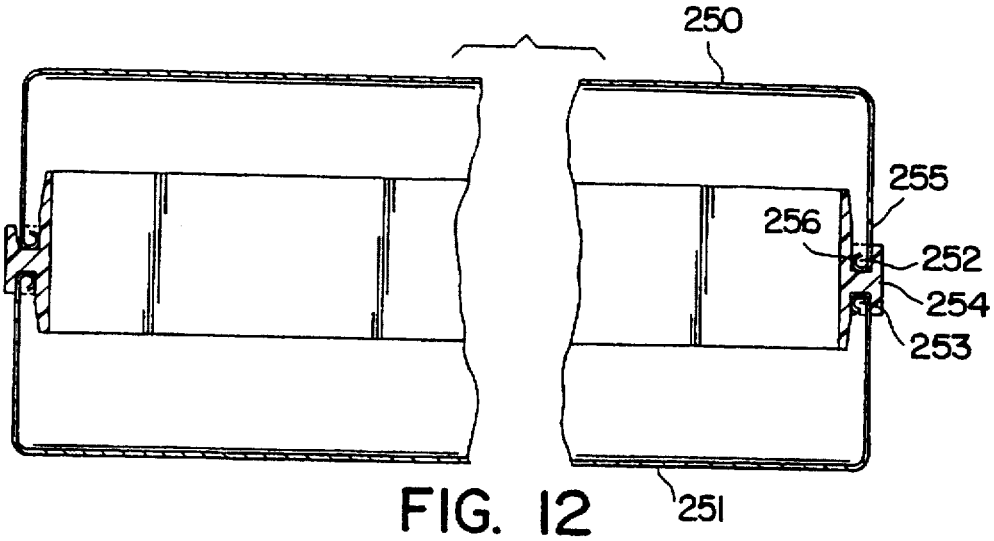
FIG. 12 is a sectional elevational of a further embodiment of the invention illustrating the use of inwardly turned formed edges, in this particular instance, curled edges.

The significance of using formed metal edges has been described in detail above. Briefly, the formed metal edge rigidifies the container, shields the raw metal edge, and provides a container feature to which the interface ring can be readily adapted. The formed metal edges which have been illustrated in the prior embodiments have typically been curled metal edges, with the curl turned outwardly. FIG. 12 is a partial view showing the application of the invention to a container also having curled metal edges, but in which the edges are curled inwardly rather than outwardly. Thus, there is shown a container top 250 and a container bottom 251 each having formed edges 252, 253, respectively, joined by an interface ring 254. The edges are curled inwardly to provide a substantially planar outer wall 255 and a curled inner wall 256. In view of the foregoing disclosure, the manner of configuring the ring to interface with such a formed edge shape interface will be apparent.

Figure 13:
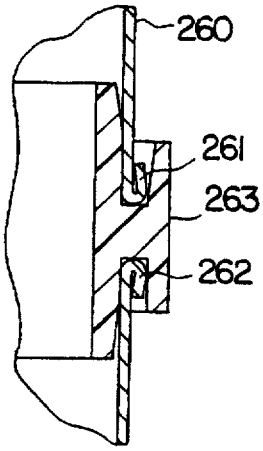
FIG. 13 is a partial sectional view illustrating the use of a container with hemmed edges.
Figure 14:
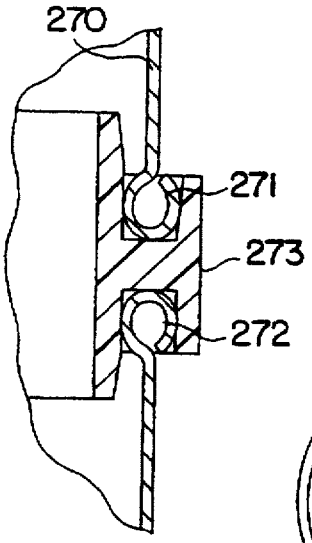
FIG. 14 is a partial sectional view like FIG. 13, and illustrating the use of teardrop shaped formed edges.

FIG. 13 illustrates application of the invention to a container 260 in which the formed edges 261, 262 are hemmed, and the hemmed edges are joined by an interface ring 263. The hemmed edges present a much flatter profile, in which the forming of the edges folds and then compresses the edge seam. FIG. 14 shows yet a further embodiment in which a container 270 having formed edges 271, 272, formed as teardrops, are joined by an interface ring 273. The teardrop-shaped edges presents a configuration where the upstanding walls of the channels are both in contact with contoured portions of the formed edges, in contrast to the prior embodiments, where one wall of the channel would be in contact with a curved edge, and the other wall of the channel would be in contact with a substantially flat portion of the edge.

It was also noted in connection with the FIG. 10 embodiment, that advantage could be taken of the injection molded interface ring by forming the ring to include internal or external special purpose features. FIG. 10 shows the incorporation of a stabilizing web 243. The stabilizing web 243 also represents the possibility of using an internal feature, such as the web 243 to assist in packaging the contents. Thus, for example, if the container were intended as a two-level container for candy, the internal web 243 could be formed in a continuous or semi-continuous fashion, and provide a base surface for supporting an upper layer of candy.

In a similar fashion, the injection molded ring can have a special purpose central feature in the form of an indented circle having a rosette at the center thereof, with the shape and configuration being adapted to retain the conventional compact disc. Thus, very short container halves of a size adapted to hold a compact disc can be used with such a special purpose interface ring to provide a commercially attractive compact disc package.

Figure 15:
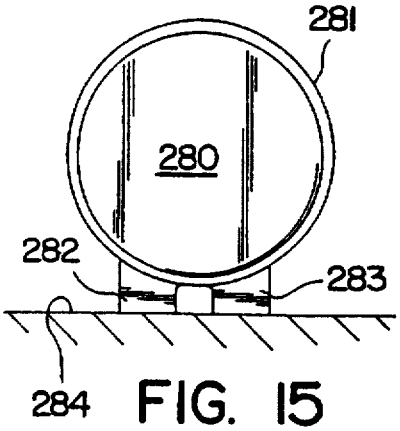
FIG. 15 is a schematic elevation illustrating the use of underlying support mechanisms as an external feature on an interface ring.
Figure 16:
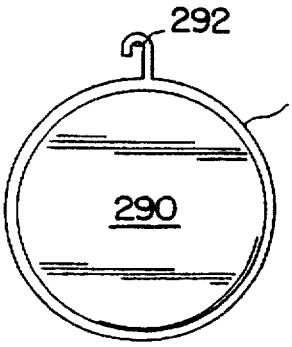
FIG. 16 is a view similar to FIG. 15 showing an example of a suspension support as an external feature of an interface ring.

FIGS. 15 and 16 show the utilization of special purpose external ring features adapted for support of the container joined by the interface ring. FIG. 15, for example, shows a container 280 having an interface ring 281 having two special purpose supports 282, 283 molded integrally with the ring 281 on the bottom thereof, so that the supports 282, 283 can be used to stand the container 280 on end on any flat surface 284. FIG. 16 shows a container 290 having a resilient interface ring 291 molded with a special feature hook 292 at one portion thereof, the hook 292 being adapted to hang the container in a suspended condition for retail display.

Figure 17:
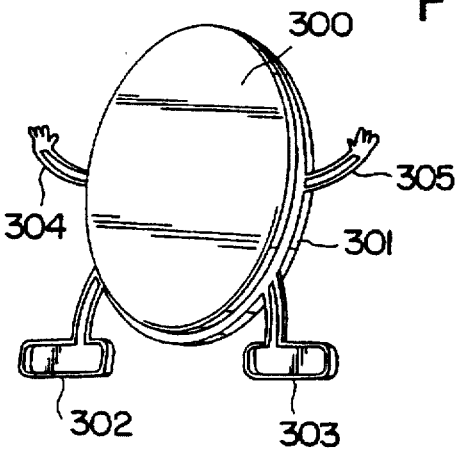
FIG. 17 is a perspective view showing an example of the invention utilizing decorative external features on an interface ring.

FIG. 17 shows yet another implementation, in which an oval shaped container 300 has an interface ring 301 formed with external features in the nature of fanciful decorations intended to compliment the printed design (not shown) typically carried on the container surface. In the FIG. 17 embodiment, the container 300 is peanut shaped, and the similarly peanut shaped interface ring 371 has molded thereon a set of fanciful features including peanut-man feet 302, 303 and peanut-man arms and feet 304, 305.

It is not possible to be exhaustive at this point, since the possibilities which are presented by the present invention will be seen to be very broad indeed. It will be apparent, however, that the invention provides the opportunity to form special purpose and highly decorative containers, in which an interface ring is used to join components which were not previously joinable, and in special applications can also provide other utilitarian or decorative features.

What is claimed is:

1. An interface ring formed of resilient material for use with two container lids having formed edges of identical size and shape so that the container lids do not interfit, the interface ring being adapted to releasably grip said container lids to form a closed container, the interface ring comprising:

opposed upper and lower channels separated by a connecting web, the channels having a size and shape which matches the size and shape of the formed edges, the channels being sufficiently wide to allow insertion of and gripping the formed edge of a container lid to provide a retention force resisting removal thereof, the overall size of the channels being substantially the same so that the identical formed edges of two lids can fit within the channels in butting relationship separated by the web, the channels being formed so that the retention force for withdrawal of an inserted lid is different between the channels to allow one channel to release before the other channel.

2. An interface ring as in claim 1, wherein the ring is formed with at least one integral external feature unitarily extending from the outside of the ring.

3. An interface ring as in claim 1, wherein the ring includes an internal feature unitarily molded with the ring.

4. An interface ring as in claim 1, wherein the ring is made of resilient plastic material.

5. An interface ring as in claim 4, wherein the ring is an injection molded polyolefin.

6. An interface ring as in claim 1, wherein the lower channel includes detent protrusions of sufficient size to allow secure attachment of the ring to the formed edge of a container lid, the detent protrusions thereby adapted to hold a container lid in the lower channel more firmly than the upper channel.

7. An interface ring as in claim 6, wherein the detent protrusions include nibs disposed at spaced locations in the lower channel adapted to snap over the formed edge of a container lid when the container lid is inserted in the lower channel.

8. An interface ring as in claim 7, wherein the container lid has an upstanding wall adjacent the formed edge with an inner surface, the lower channel including crush ribs protruding from a channel wall of sufficient size to allow engagement of the ribs with the inner surface when the formed edge is inserted in the lower channel, the lower channel thereby adapted to achieve a snug fit between the lower channel and the container lid.

9. An interface ring as in claim 6, wherein the upper channel includes vent means adapted to prevent vacuum buildup when a container lid is removed from the upper channel.

10. An interface ring as in claim 9, wherein the vent means includes L-shaped ridges transversely disposed in the upper channel adapted to prevent formation of an air-tight seal between the upper channel and the formed edge of said container lid.

11. An interface ring as in claim 9, wherein the vent means includes slots segmenting walls of the upper channel and interrupting the upper channel.

12. An interface ring as in claim 6, wherein the ring has a pinch-to-open area, the pinch-to-open area including two standoff ridges in the upper channel bracketing a recess therebetween of sufficient size to receive an adjacent portion of the formed edge of the container lid, the pinch-to-open area thereby adapted to pivot a section of said container lid opposite the pinch-to-open area out of the upper channel.

13. An interface ring as in claim 2, in which the external feature has a shape and position adapted to support the container lids when attached to the ring.

14. An interface ring as in claim 3, wherein the ring includes a U-shaped stabilizing web of sufficient size and shape to extend toward the container lid when attached to the lower channel, the web having two downward portions of sufficient size and shape to extend along upstanding walls of said container lid, and a horizontal portion of sufficient size and shape to extend across a closed end of said container lid.

15. An interface ring as in claim 1, wherein the ring is a plastic unitary member injection molded in a complex non-rectangular shape.

16. An interface ring formed of resilient material for use with two container halves having formed edges of identical size and shape so that the container halves do not interfit, the interface ring being adapted to releasably secure said container halves to form an openable closed container, the interface ring comprising:

opposed upper and lower seats having a size and shape which matches the size and shape of the formed edges, the seats sharing a common base for engaging facing portions of the formed edges of the respective container halves, each seat having at least one upstanding wall extending around the ring and comprising means for gripping the formed edge of a container half when seated therein to provide a retention force resisting removal thereof, the respective seats having non-identical gripping characteristics for the formed edges of the associated container halves such that the retention force for removal of the formed edge of a seated container half is different between the two seats to allow a predetermined one of the seats to release before the other.

17. A ring as in claim 16, wherein the lower seat includes two upstanding walls defining a channel of sufficient width to allow insertion of the formed edge of a container half and provide the retention force resisting removal thereof.

18. A ring as in claim 16, wherein the upper seat includes two upstanding walls defining a channel of sufficient width to allow insertion of the formed edge of a container half and provide the retention force resisting removal thereof.

19. A ring as in claim 16, wherein the upper seat includes only one upstanding wall sized to snugly fit one side of the formed edge of a container half.

20. A ring as in claim 16 wherein at least one of the upstanding walls is segmented and another of the upstanding walls is continuous about a periphery of the ring.

21. A ring as in claim 16, wherein the lower seat includes detent nibs protruding at spaced locations from one of the two upstanding walls, the detent nibs sized to securely capture the formed edge of a container half when inserted therein.

22. A ring as in claim 16, wherein the common base is a web separating the upper and lower seats.

23. A ring as in claim 16, wherein the ring is a unitary member injection molded in a non-rectangular complex shape.

* * * * *